United States Patent [19]

Wilson et al.

[11] Patent Number: 4,563,553

[45] Date of Patent: Jan. 7, 1986

[54] CIRCUIT BREAKER HAVING INTEGRAL COVER/HANDLE ASSEMBLY

[75] Inventors: James C. Wilson; William I. Stephenson, both of Beaver; Walter V. Bratkowski, McKeesport, all of Pa.

[73] Assignee: Westinghouse Electric Corp., Pittsburgh, Pa.

[21] Appl. No.: 584,969

[22] Filed: Mar. 1, 1984

[51] Int. Cl.[4] ..... H01H 3/00

[52] U.S. Cl. ..... 200/17 R; 200/50 R; 200/293; 200/339

[58] Field of Search ..... 200/50 A, 50 C, 17 R, 200/302.3, 331, 339, 50 R, 330, 153 G, 293–296, 333, 329

[56] References Cited

U.S. PATENT DOCUMENTS

| | | | |
|---|---|---|---|
| 1,493,413 | 5/1964 | Anderson | 200/302.3 |
| 2,878,347 | 3/1959 | Schmidt | 200/302.3 |
| 3,211,877 | 10/1965 | Walker et al. | 200/302.3 |
| 3,319,035 | 5/1967 | Gelzheiser | 200/302.3 |
| 4,242,551 | 12/1980 | Sorenson | 200/302.3 |

*Primary Examiner*—J. R. Scott

*Attorney, Agent, or Firm*—John Victor Pezdek

[57] ABSTRACT

A circuit breaker having an integral handle cover assembly for manual operation of the circuit breaker. The handle assembly comprises a cap segment and a base segment. The base segment removably engages with the operating mechanism of the circuit breaker with the cap segment positioned exterior to the circuit breaker cover and engaged with the base segment such that the handle assembly is attached to the cover while being movable in the opening thereof during the opening and closing of the circuit breaker allowing the cover to be removed from the circuit breaker without the detachment of the handle assembly from the cover.

29 Claims, 8 Drawing Figures

CIRCUIT BREAKER HAVING INTEGRAL COVER/HANDLE ASSEMBLY

BACKGROUND OF THE INVENTION

This invention relates to circuit breakers and in particular to the handle mechanisms used to manually open and close the circuit breaker.

Typically a handle which is removably connected to the operating mechanism is provided for manual operation of the circuit breaker. The handle projects through an opening provided in the removable cover of the circuit breaker. The cover and handle assembly are removable in order to facilitate maintenance or inspection of the internal components of the circuit breaker. One problem encountered by having these two pieces being removable is that the handle tends to slip from the cover and can become lost or broken. Thus, it would be advantageous to have an integral cover handle assembly where the handle mechanism is attached to the cover yet capable of still being used for manual operation of the circuit breaker.

SUMMARY OF THE INVENTION

The present invention is embodied by a handle assembly for manually controlling the operating mechanism of a circuit breaker. The handle assembly includes a base segment and a cap segment with the base segment being removably engaged with the operating mechanism of the circuit breaker. Positioned exterior to an opening provided in the cover of the circuit breaker housing is the cap segment. This segment engages with the base segment such that the handle is attached to the cover while being movable in the opening thereof during the transfer of the circuit breaker between the open and closed positions. The base segment can include an apron portion which extends out from the base segment such that the opening in the cover is closed as the handle assembly travels between the open and closed positions during operation of the circuit breaker. The apron is in close movable engagement with the cover in order to prevent the insertion of foreign objects into the internal workings of the circuit breaker.

In an alternate embodiment the operating mechanism of the circuit breaker can be provided with a tang projecting therefrom with the base segment having a bore therein for receiving and engaging this tang in a loosely fitting manner. The shape of the bore and the base segment of the handle is such that the tang remains in engagement with the base segment while allowing the handle to follow a line of motion which differs from the line of motion followed by the tang of the operating mechanism. Because the tang is loosely fitting inside the bore of the base segment, this facilitates mounting of the cover handle assembly onto the operating mechanism of the circuit breaker. In addition, this allows the handle to travel through a longer operating distance than the mechanism thus facilitating the differentiation between the on and off positions of the circuit breaker. Preferably, the cap and base segment are provided with locking edges to facilitate the mounting of the cap segment onto the base segment of the handle. By fabricating the cap from a material having some resilient qualities such as nylon, the cap assembly may be snapped onto the base segment thus eliminating the need for any tools or other fasteners for engaging the cap and base segments together.

BRIEF DESCRIPTION OF THE DRAWINGS

For a better understanding of the invention, reference may be made to the embodiments exemplary of the invention shown in the accompanying drawings wherein.

DETAILED DESCRIPTION

Figure 1:
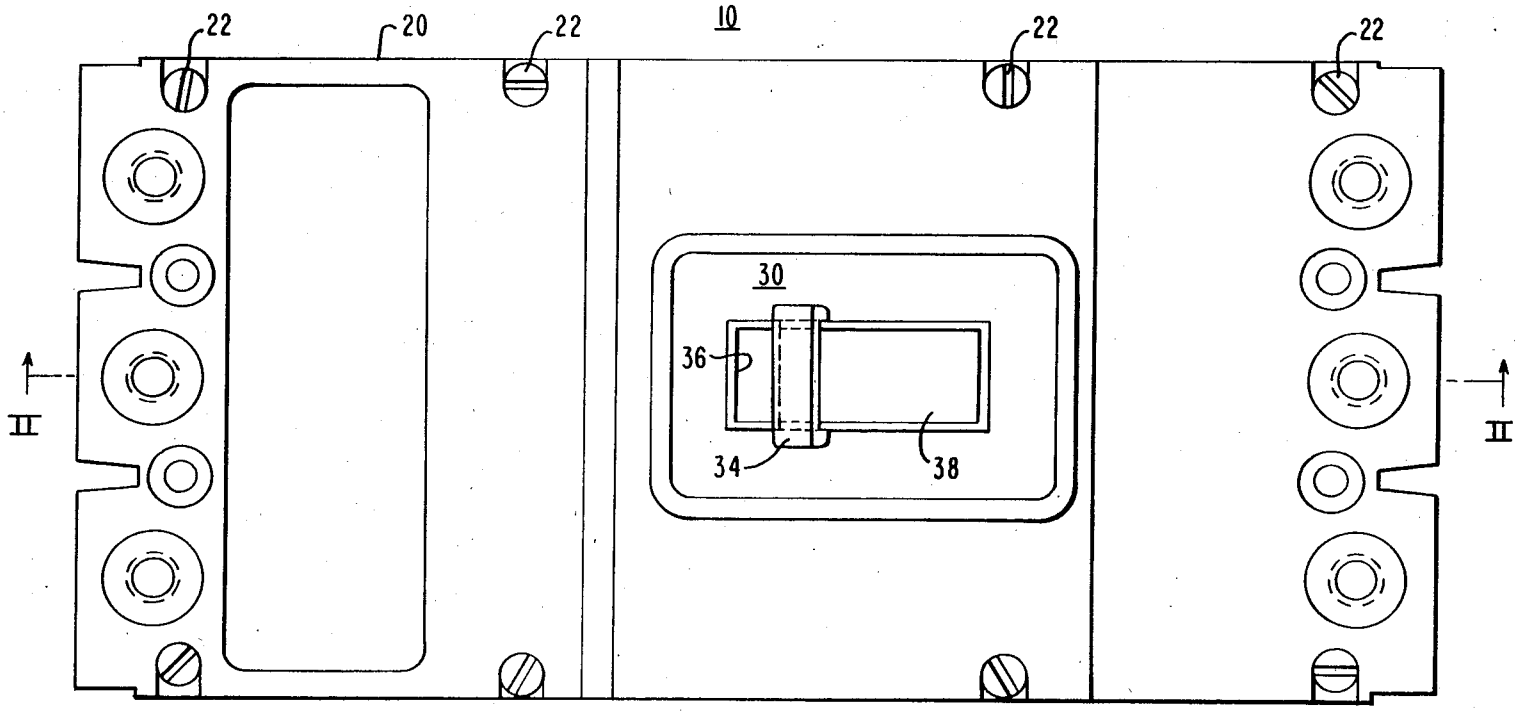
FIG. 1 is a front view of the circuit breaker embodying the present invention.
Figure 2:
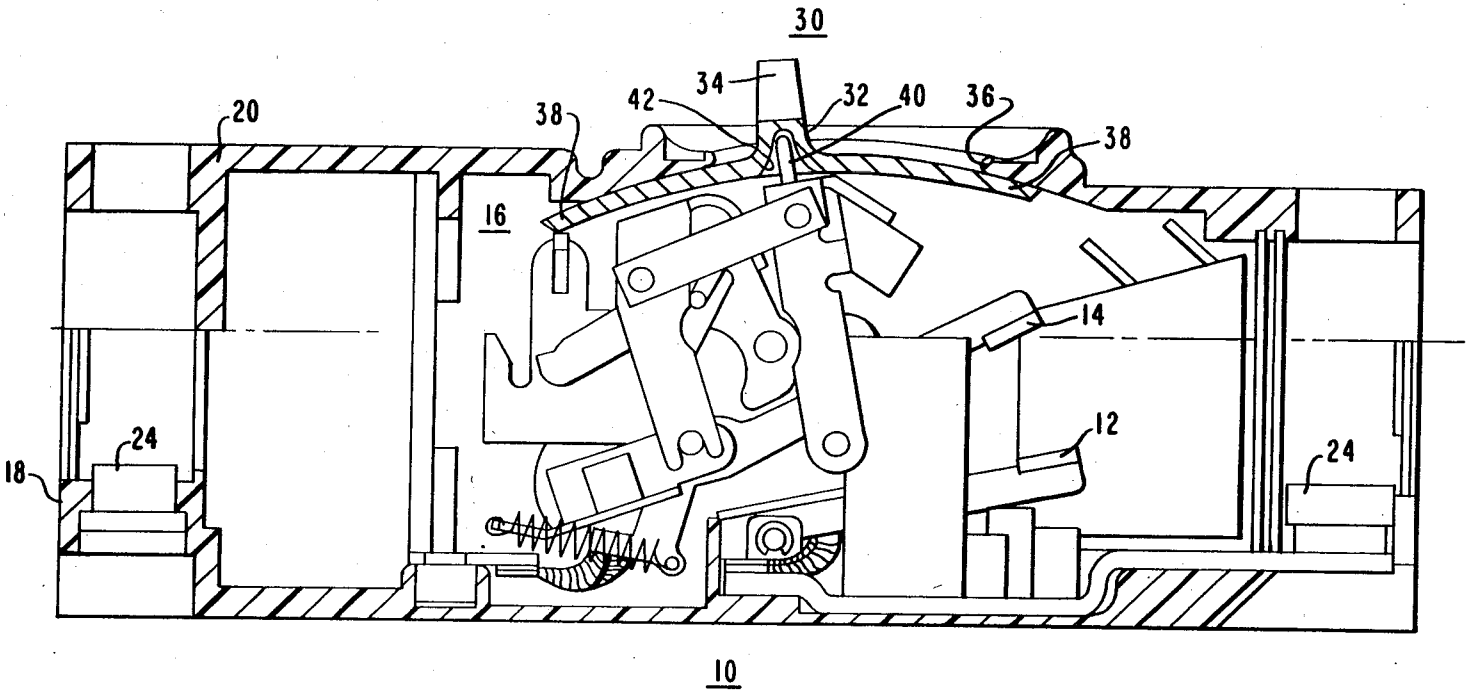
FIG. 2 is a sectional view of the circuit breaker shown in FIG. 1 taken along line II—II.
Figure 8:
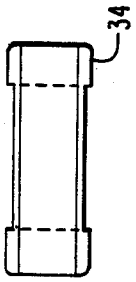
FIG. 8 is a top view of the cap segment of the handle mechanism.
Figure 7:
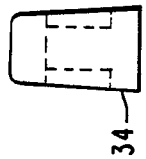
FIG. 7 is a side elevational view of the cap segment of the handle mechanism.
Figure 6:
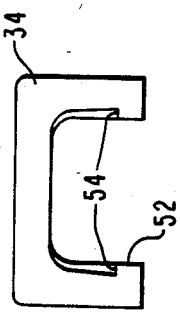
FIG. 6 is a front elevational view of the cap segment of the handle mechanism.
Figure 4:
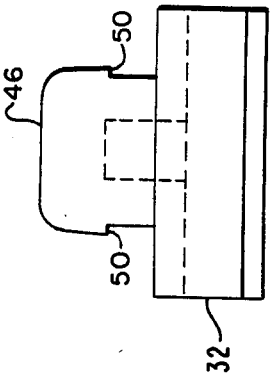
FIG. 4 is a side elevational view of the base segment of the handle mechanism.
Figure 5:
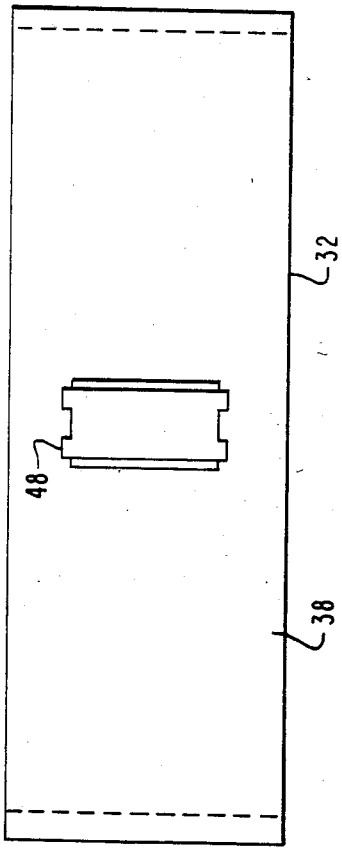
FIG. 5 is a top view of the base segment of the handle mechanism.
Figure 3:
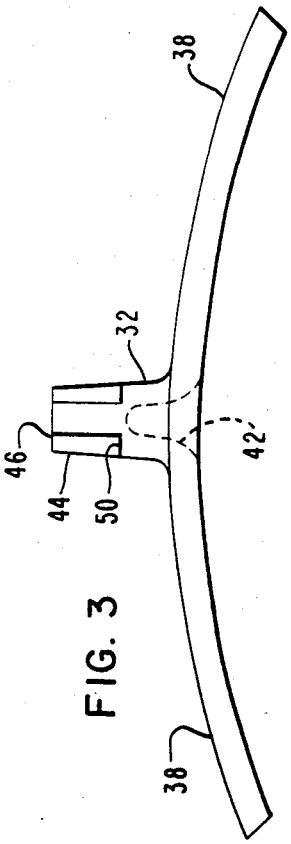
FIG. 3 is a front elevational view of the base segment of the handle mechanism.

Referring to FIGS. 1 and 2, the circuit breaker 10 embodying the present invention comprises a stationary contact 12 for conducting current, and a movable contact 14 for conducting current with the movable contact 14 operable between an open position and a closed position with respect to the stationary contact. An operating mechanism generally indicated at 16 consisting of springs, linkages, and pivots is used to transfer the movable contact 14 between the open and closed positions. A housing 18 including a removable cover 20 is provided for enclosing and electrically insulating the stationary contact 12, the movable contact 14 and the operating mechanism 16. Screws 22 or other fasteners are used to secure the cover 20 to the remainder of the housing 18. Terminals 24 for connecting current carrying conductors to the stationary and movable contacts are provided in the housing 18.

Referring to FIGS. 2–8, a handle assembly 30 consisting of the base segment 32 and a cap segment 34 is used for manually controlling the operating mechanisms 16 as well as indicating the open (OFF) and closed (ON) positions of the circuit breaker. The base segment 32 is removably engaged with the operating mechanism 16 while the cap segment 34 is positioned exterior to the cover 20 and engages with the base segment 32 through an opening 36 provided in the cover 20 for this purpose. The base segment 32 and cap segment 34 are connected such that the handle assembly 30 moves in the opening 36 during the transfer of the movable contact 14 between the open and closed positions but yet remains attached to the cover 20. Preferably, the base segment 32 is provided with an apron portion 38 extending out from the base segment 32 and in close movable engagement with the cover (see FIG. 2). The apron 38 extends out from the base segment 32 such that the opening 36 in the cover 20 is closed as the handle assembly 30 travels in the opening 36 during operation of the circuit breaker between the open and closed positions. The apron 38 prevents the insertion of foreign objects into the internal mechanisms of the circuit breaker.

Various means of removably engaging the base segment with the operating mechanism 16 can be used. Preferably, a tang 40 is provided on the operating mechanism 16 and a corresponding bore 42 is provided in the base segment 32 for receiving and engaging the tang 40. The shape of the bore 42 is such that the base segment 32 loosely sits or fits about the tang 40. The loose fit permits the tang 40 to remain in engagement with the base segment 32 of the handle assembly 30 while allowing the handle assembly to follow a line of motion differing from the line of motion followed by the tang 40 of the operating mechanism 16 during the transfer of the movable contact 14 between the open and closed positions. As can be seen in FIG. 2, during transfer of the movable contact 14 from the closed to open position or from the open to close position, the path followed by the handle assembly will be slightly longer than that followed by the operating mechanism. This allows for greater differentiation between the open (OFF) and closed (ON) positions of the circuit breaker. The loose fit between the tang 40 and the base segment 32 of the handle assembly also facilitates installation of the cover 20 and handle assembly 30 onto the the housing 18 and operating mechanism 16.

As can be appreciated, various arrangements for the engagement of the cap 34 to the base segment are possible. For example, the base segment can be provided with an additional bore for receiving a portion of the cap segment that can extend through the opening 36 in the cover 20. Preferably, however the base segment 32 is provided with an arm 44, the free end 46 of which projects through the opening 36 of the cover 20. The cap segment 34 engages a portion of the arm 44 exterior to the cover 20 forming an integral handle cover assembly. Again, the handle while being attached to the cover 20 is movable in the opening 36 thereof during the opening and closing of the circuit breaker.

The lateral surfaces 48 of the arm can be provided with a locking edge 50 intermediate the ends thereof. The cap segment 34 is provided with a bore 52 substantially conforming to the shape of the exterior portion of the arm 44. The bore surface opposite the locking edge 50 of the arm has a corresponding mating edge 54 for engaging the locking edge 50 when the cap segment 34 is placed onto the arm 44. When the locking edge 50 and mating edge 54 engage, the cap segment 34 is locked in place on the arm 44 preventing the removal of the handle assembly 30 from the cover 20. Preferably, locking edges 50 are provided on at least two opposite lateral surfaces 48 of the arm 44 with the surface of the bore 52 of the cap segment 34 having mating edges 54 corresponding to the number of locking edges 50. In order to facilitate assembly of the cap segment 34 onto the arm 44, the arm 44 and cap segment bore 52 can have corresponding tapers. The tapering would be such that the distance between the planes formed by the opposite lateral surfaces 48 of the arm decreases along a line beginning at the locking edges or mating edges and extending to the free end 46 of the arm 44.

Preferably, the cap segment 34, the base segment 32 or both should be fabricated from the material having some resilience in order to allow the engagement of the cap segment 34 onto the base segment 34 of the handle assembly 30. Typically, the resilience of the material used for fabrication allows the cap segment 34 to be snapped into place on arm 44 the base segment 32. Thus obviating the need for any fastening means such as screws or bolts. Preferably, the material of fabrication should also possess good electrical insulating properties. This eliminates the need to provide some other form of electrical insulation between the handle assembly and the operating mechanism.

With the cap segment 34 locking in place on the base segment 32, the cover 20 can now be removed from the circuit breaker 10 with the handle assembly 30 remaining attached to the cover 20 because of their size neither the cap segment nor the base segment can pass through the opening 36 in the cover 20. As shown in the figures, the portion of the handle assembly in the opening 36 in the cover 20 closely fits in the opening 36. This prevents the handle assembly 30 from rotating or twisting in the opening 36 when the cover is removed from the circuit breaker and allowing the cap segment 34 to drop through the opening 36 in the cover 20. However, it is possible to size the handle assembly 30 that is in the opening 36 and the cap segment 34 to be such that the handle assembly 30 can be rotated approximately 90° to permit the withdrawal of the assembled cap segment from the cover while still attached to the base segment.

Other embodiments of the invention will be apparent to those skilled in the art from the consideration of the specification or practice of the invention disclosed. It is intended that the specification be considered as exemplary only with the true scope and spirit of the invention indicated by the following claims.

We claim:

1. A circuit breaker, comprising:

stationary contact means for conducting current;

movable contact means for conducting current movable between an open position and a closed position with respect to the stationary contact means.

operating means for transferring the movable contact means between the open and the closed positions;

housing means for enclosing and electrically insulating the stationary contact means, the movable contact means and the operating means, the housing means including a removable cover having an opening therethrough; and handle means for manually controlling the operating means, the handle means including a base segment and a cap segment, the base segment removably engaged with the operating means, the cap segment positioned exterior to the cover and engaged with the base segment preventing the unintentional removal of the handle means from the cover with the handle means being attached to the cover while being movable in the opening thereof during transfer of the movable contact means between the open and closed positions thereby forming an integral handle means-cover assembly.

2. The circuit breaker of claim 1 wherein the base segment includes an apron portion in close movable engagement with the cover, the apron extending out from the base segment such that the opening in the cover is closed as the handle means travels in the opening during the transfer of the movable contact means between the open and closed positions.

3. The circuit breaker of claim 1 wherein the portion of the operating means in engagement with the base segment is provided with a tang projecting therefrom and the base segment has a bore therein for receiving and engaging the tang, the shape of the bore being such that the tang remains in engagement with the base segment while allowing the handle means to follow a line of motion differing from the line of motion followed by the tang of the operating means during the transfer of the movable contact between the open and closed positions.

4. A circuit breaker, comprising:

stationary contact means for conducting current;

movable contact means for conducting current movable between an open position and a closed position with respect to the stationary contact means;

operating means for transferring the movable contact means between the open position and the closed position;

housing means for enclosing and electrically insulating the stationary contact means, the movable contact means and the operating means, the housing means including a removable cover having an opening therethrough; and handle means for manually controlling the operating means, the handle means including a base segment and a cap segment, the base segment removably engaged with the operating means and having an arm projecting therefrom, the free end of the arm extending through the opening in the cover, the cap segment engaging a portion of the arm exterior to the cover preventing the unintentional removal of the handle means from the cover with the handle means being attached to the cover while being movable in the opening thereof during transfer of the movable contact means between the open and closed positions thereby forming an integral handle means-cover assembly.

5. The circuit breaker of claim 4 wherein the base segment includes an apron portion in close movable engagement with the cover, the apron extending out from the base segment such that the opening in the cover is closed as the handle means travels in the opening of the cover during the transfer of the movable contact means between the open and closed positions.

6. The circuit breaker of claim 5, wherein a lateral surface of the exterior portion of the arm has a locking edge intermediate the ends thereof and the cap segment has a bore therein substantially conforming to the shape of the exterior portion of the arm with the bore surface opposite the locking edge of the arm having a corresponding mating edge for engaging the locking edge when the cap segment is placed onto the arm thereby locking the cap segment in place on the arm and preventing the removal of the handle means from the cover.

7. The circuit breaker of claim 6 wherein the locking edges are provided on at least two opposite lateral surfaces of the arm with the surface of the bore of the cap segment having mating edges corresponding to the number of locking edges.

8. The circuit breaker of claim 7 wherein the distance between the planes formed by the opposite lateral surfaces of the arm decreases along a line beginning at the locking edges and extending to the free end of arm.

9. The circuit breaker of claim 8 wherein the cap segment is fabricated from nylon.

10. The circuit breaker of claim 4 wherein the portion of the operating means in engagement with the base segment is provided with a tang projecting therefrom and the base segment has a bore therein for receiving and engaging the tang, the shape of the bore being such that the tang remains in engagement with the base segment while allowing the handle means to follow a line of motion differing from the line of motion followed by the tang of the operating means during the transfer of the movable contact means between the open and closed positions.

11. The circuit breaker of claim 10 wherein the base segment includes an apron portion in close movable engagement with the cover, the apron extending out from the base segment such that the opening in the cover is closed as the handle means travels in the opening of the cover during the transfer of the movable contact means between the open and closed positions.

12. The circuit breaker of claim 11 wherein a lateral surface of the exterior portion of the arm has a locking edge intermediate the ends thereof and the cap segment has a bore therein substantially conforming to the shape of the exterior portion of the arm with the bore surface opposite the locking edge of the arm having a corresponding mating edge for engaging the locking edge when the cap segment is placed onto the arm thereby locking the cap segment in place on the arm and preventing the removal of the handle means from the cover.

13. The circuit breaker of claim 12 wherein the locking edges are provided on at least two opposite lateral surfaces of the arm with the surface of the bore of the cap segment having mating edges corresponding to the number of locking edges.

14. The circuit breaker of claim 13 wherein the distance between the planes formed by the opposite lateral surfaces of the arm decreases along a line beginning at the locking edges and extending to the free end of arm.

15. The circuit breaker of claim 14 wherein the cap segment is fabricated from nylon.

16. A handle assembly for manual operation of a circuit breaker contact operating means accessible through an opening in a removable cover of the circuit breaker housing, comprising:

a base segment; and a cap segment, the base segment removably engaged with the contact operating means, the cap segment positioned exterior to the cover and engaged with the base segment preventing the unintentional removal of the handle assembly from the cover with the handle assembly being attached to the cover while being movable in the opening thereof during opening and closing of the circuit breaker thereby forming an integral handle-cover assembly.

17. The handle assembly of claim 16 wherein the base segment includes an apron portion in close movable engagement with the cover, the apron extending out from the base segment such that the opening in the cover is closed as the handle assembly travels in the opening during the opening and closing of the circuit breaker.

18. A handle assembly for manual operation of a circuit breaker contact operating means accessible through an opening in a removable cover of the circuit breaker housing, comprising:

a base segment; and a cap segment, the base segment removably engaged with the contact operating means and having an arm projecting therefrom, the free end of the arm extending through the opening in the cover, the cap segment engaging a portion of the arm exterior to the cover preventing the unintentional removal of the handle assembly from the cover with the handle assembly being attached to the cover while being movable in the opening thereof during the opening and closing of the circuit breaker thereby forming an integral handle-cover assembly.

19. The handle assembly of claim 18 wherein the base segment includes an apron portion in close movable engagement with the cover, the apron extending out from the base segment such that the opening in the cover is closed as the handle assembly travels in the opening during the opening and closing of the circuit breaker.

20. The handle assembly of claim 19 wherein a lateral surface of the exterior portion of the arm has a locking edge intermediate the ends thereof and the cap segment has a bore therein substantially conforming to the shape of the exterior portion of the arm with the bore surface opposite the locking edge of the arm having a corresponding mating edge for engaging the looking edge when the cap segment is placed onto the arm thereby locking the cap segment in place on the arm and preventing the removal of the handle assembly from the cover.

21. The handle assembly of claim 20 wherein the locking edges are provided on at least two opposite lateral surfaces of the arm with the surface of the bore of the cap segment having mating edges corresponding to the number of locking edges.

22. The handle assembly of claim 21 wherein the distance between the planes formed by the opposite lateral surfaces of the arm decreases along a line beginning at the locking edges and extending to the free end of the arm.

23. The handle assembly of claim 22 wherein the cap segment is fabricated from nylon.

24. The handle assembly of claim 18 wherein the portion of the operating means in engagement with the base segment is provided with a tang projecting therefrom and the base segment has a bore therein for receiving and engaging the tang, the shape of the bore being such that the tang remains in engagement with the base segment while allowing the handle assembly to follow a line of motion differing from the line of motion followed by the tang of the operating means during the opening and closing of the circuit breaker.

25. The handle assembly of claim 24 wherein the base segment includes an apron portion in close movable engagement with the cover, the apron extending out from the base segment such that the opening in the cover is closed as the handle assembly travels in the opening during the opening and closing of the circuit breaker.

26. The handle assembly of claim 25 wherein a lateral surface of the exterior portion of the arm has a locking edge intermediate the ends thereof and the cap segment has a bore therein substantially conforming to the shape of the exterior portion of the arm with the bore surface opposite the locking edge of the arm having a corresponding mating edge for engaging the locking edge when the cap segment is placed onto the arm thereby locking the cap segment in place on the arm and preventing the removal of the handle assembly from the cover.

27. The handle assembly of claim 26 wherein the locking edges are provided on at least two opposite lateral surfaces of the arm with the surface of the bore of the cap segment having mating edges corresponding to the number of locking edges.

28. The handle assembly of claim 27 wherein the distance between the planes formed by the opposite lateral surfaces of the arm decreases along a line beginning at the locking edges and extending to the free end of arm.

29. The handle assembly of claim 28 wherein the cap segment is fabricated from nylon.

* * * * *